US005657520A

United States Patent [19]

Greenway et al.

[11] Patent Number: 5,657,520

[45] Date of Patent: Aug. 19, 1997

[54] METHOD FOR TENTERING HYDROENHANCED FABRIC

[75] Inventors: J. Michael Greenway, Westwood; Frederick Ty, Attleboro, both of Mass.

[73] Assignee: International Paper Company, Purchase, N.Y.

[21] Appl. No.: 378,693

[22] Filed: Jan. 26, 1995

[51] Int. Cl.[6] ..... D06C 3/00; D04H 1/46

[52] U.S. Cl. ..... 26/51; 26/89; 28/104

[58] Field of Search ..... 28/112, 104, 167; 26/51, 71, 72, 87, 88, 89, 69 R

[56] References Cited

U.S. PATENT DOCUMENTS

| | | | |
|---|---|---|---|
| Re. 31,601 | 6/1984 | Ikeda et al. | 428/93 |
| 485,400 | 11/1892 | Watson . | |
| 2,006,814 | 7/1935 | Payet | 26/72 |
| 2,192,880 | 3/1940 | Cohn et al. | 26/55 |
| 2,338,983 | 1/1944 | Thackston et al. | 26/18.5 |
| 2,862,251 | 12/1958 | Kalwaites | 19/161 |
| 2,915,889 | 12/1959 | Ethridge | 68/62 |
| 3,092,888 | 6/1963 | Mizell et al. | 26/18.5 |
| 3,172,150 | 3/1965 | Dornier | 26/72 |
| 3,518,848 | 7/1970 | Becker | 68/18 |
| 3,551,546 | 12/1970 | Gosper et al. | 26/72 |
| 3,597,851 | 8/1971 | Arendt et al. | 34/60 |
| 3,731,351 | 5/1973 | Kocay et al. | 28/167 |
| 3,747,161 | 7/1973 | Kalwaites | 19/161 |
| 4,377,889 | 3/1983 | Tatham et al. | 28/112 |
| 4,497,097 | 2/1985 | Schneider et al. | 28/112 |
| 4,612,237 | 9/1986 | Frankenburg | 428/219 |
| 4,718,152 | 1/1988 | Suzuki et al. | 28/104 |
| 4,939,016 | 7/1990 | Radwanski et al. | 28/104 |
| 4,960,630 | 10/1990 | Greenway et al. | 428/131 |
| 4,967,456 | 11/1990 | Sternlieb et al. | 28/104 |
| 4,995,151 | 2/1991 | Siegel et al. | 26/69 |
| 5,023,130 | 6/1991 | Simpson et al. | 428/227 |
| 5,080,952 | 1/1992 | Willbanks | 428/91 |
| 5,136,761 | 8/1992 | Sternlieb et al. | 28/104 |

FOREIGN PATENT DOCUMENTS

| | | |
|---|---|---|
| 287821 | 3/1966 | Australia . |
| 739652 | 8/1966 | Canada . |
| 0 177 277 A1 | 4/1985 | European Pat. Off. . |
| 54-11433 | 5/1979 | Japan . |
| 57-35051 | 2/1982 | Japan . |
| 61-252339 | 11/1986 | Japan . |
| 61-58573 | 12/1986 | Japan . |
| 1063252 | 3/1967 | United Kingdom . |

OTHER PUBLICATIONS

Beaumont, Roberts, "Woolen and Worsted, G. Bell and Sons, Ltd., London", pp. 625–627 (1915).

Marsh, John Thompson, "Textile Science: An Introductory Manual", Chapman & Hall Ltd., London, pp. 329–333 (1949).

*Primary Examiner*—Amy B. Vanatta

*Attorney, Agent, or Firm*—Ostrager, Chong & Flaherty

[57] ABSTRACT

Woven or knit fabric is pre-tentered (stretched) prior to hydroenhancement treatment to a predetermined width in excess of the desired finished width of the fabric. The pre-tentering width is selected so that the expected shrinkage caused by the hydroenhancing process reduces the width of the enhanced fabric to slightly less than the desired finished width. The fabric is post-tentered hydroenhancing process only by a slight amount to the exact desired finished width. Since only a slight increase in width is required, there is very little loss in cover of the enhanced fabric. Post-tentering to a slight increase in width will also provide a slight tension for holding the fabric in the tenter clips and prevent the fabric from dragging in the tenter.

10 Claims, 3 Drawing Sheets

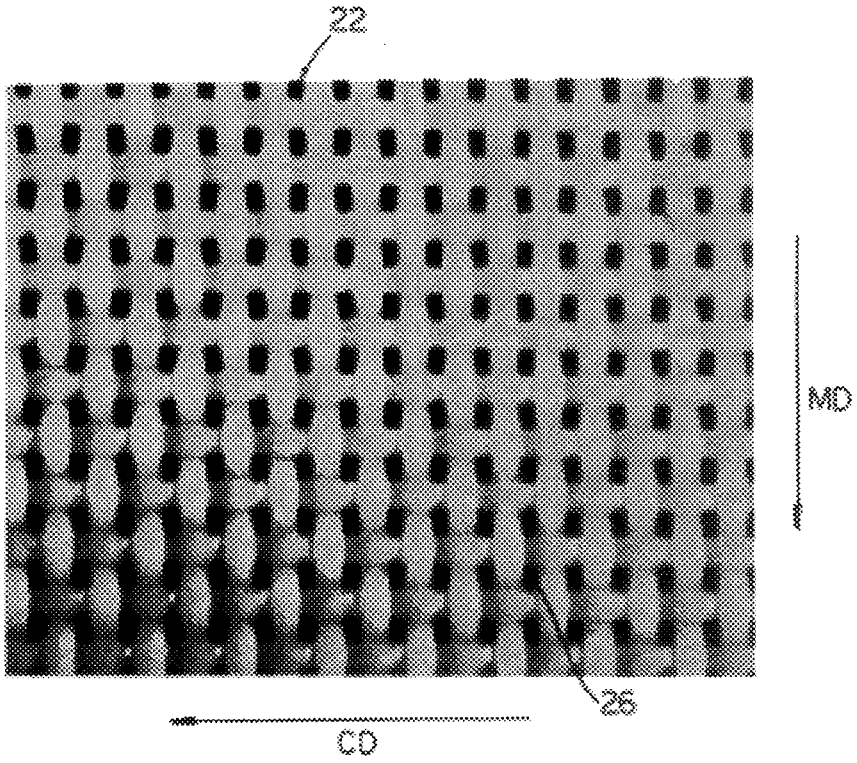
FIG. 2A
FIG. 2B
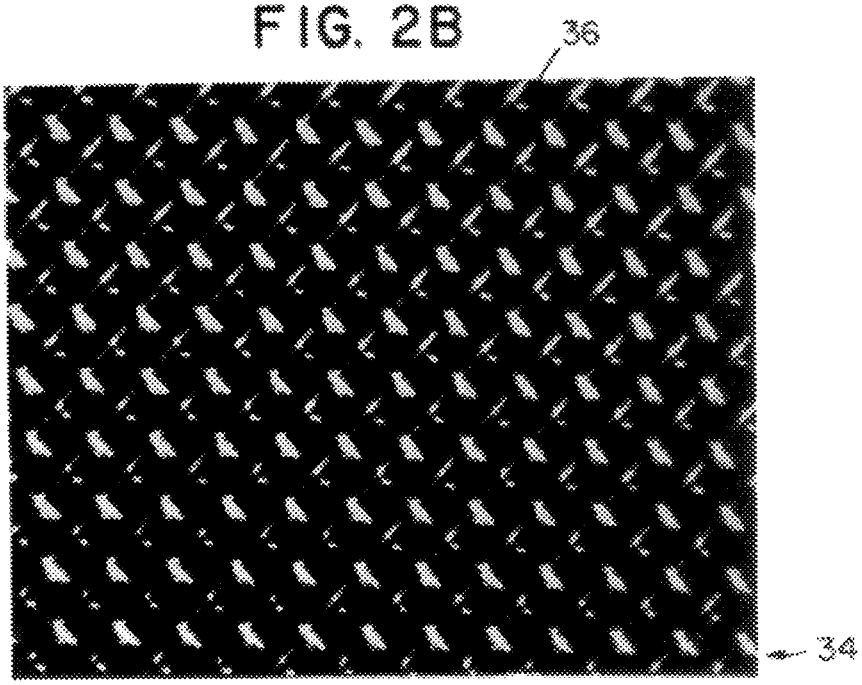

METHOD FOR TENTERING HYDROENHANCED FABRIC

SPECIFICATION

1. Field of Invention

This invention generally relates to an improvement in the hydroenhancement process for woven and knit fabrics. Hydroenhancement employs fluid jet treatment of woven and knit fabrics to cause the fabric yarns to inter-entangle and bloom, resulting in enhanced surface finish and texture, durability, and other improved characteristics such as cover, abrasion resistance, drape, stability, reduced air permeability, wrinkle recovery, absorption, adsorption, shrink resistance, seam slippage, and edge fray.

2. Background Art

The quality of a woven or knit fabric can be measured by various properties, such as the yarn count, thread count, abrasion resistance, cover, weight, yarn bulk, yarn bloom, torque resistance, wrinkle recovery, drape and hand.

Yarn count is the numerical designation given to indicate yarn size and is the relationship of length to weight.

Thread count in woven or knit fabrics, respectively, defines the number ends and picks, and wales and courses per inch of fabric. For example, the count of cloth is indicated by enumerating first the number of warp ends per inch, then the number of filling picks per inch. Thus, 68×72 defines a fabric having 68 warp ends and 72 filling picks per inch.

Abrasion resistance is the ability of a fabric to withstand loss of appearance, utility, pile or surface through destructive action of surface wear and rubbing.

Absorption is the process of gases or liquids being taken up into the pores of a fiber, yarn, or fabric.

Adsorption is the attraction of gases, liquids, or solids to surface areas of textile fibers, yarns, fabrics or any material.

Cover is the degree to which underlying structure in a fabric is concealed by surface material. A measure of cover is provided by fabric air permeability, that is, the ease with which air passes through the fabric. Permeability measures fundamental fabric qualities and characteristics such as filtration and cover.

Yarn bloom is a measure of the opening and spread of fibers in yarn.

Fabric weight is measured in weight per unit area, for example, the number of ounces per square yard.

Torque of fabric refers to that characteristic which tends to make it turn on itself as a result of twisting. It is desirable to remove or diminish torque in fabrics. For example, fabrics used in vertical blinds should have no torque, since such torque will make the fabric twist when hanging in a strip.

Wrinkle recovery is the property of a fabric which enables it to recover from folding deformations.

Fabric surface durability is the resistance of a material to loss of physical properties or appearance as result of wear or dynamic operation.

Hand refers to tactile fabric properties such as softness and drapability.

Hydroenhancement techniques have been developed for enhancing the surface finish and texture, durability, and other characteristics of woven or knit spun and/or spun filament yarn fabric. For example, such techniques are described in commonly owned U.S. Pat. No. 4,967,456 of H. Sternlieb et al., issued Nov. 6, 1990 which is incorporated herein by reference. The hydroenhancing process generally includes exposing one or both surfaces of a fabric to fluid jet treatment, followed by pressing out moisture from the fabric and drying. During hydroenhancement, the high pressure water jets impact upon the spun yarns and cause them to bulk or bloom and the fibers in the yarns to become interentangled. In this manner the open areas of the fabric are filled in and the cover of the fabric is increased. These results are advantageously obtained without requirement of conventional fabric finishing processes.

However, it has been found that a problem with hydroenhancement is the weft shrinkage of fabric caused by the hydroenhancing process. In some fabrics, the degree of shrinkage can be as much as 10% of the original width of the fabric or higher. Shrinkage is thought to be caused by a reduction in the lengths of the yarns. When blooming and entangling take place, the filament path in the yarn becomes changed. This causes some reduction in length in the yarns which results in fabric shrinkage.

A conventional approach to the problem of shrinkage of hydroenhanced fabric has been to tenter (stretch) the fabric after hydroenhancement in an attempt to regain the original width of the fabric. However, stretching the fabric after hydroenhancement stretches the yarns and causes the filaments to be pulled back into the yarn bundle which in turn reduces fabric cover. Improved cover is one of the primary benefits of the hydroenhancing process and any reduction in cover is undesirable.

Another approach to eliminating shrinkage is to hold the fabric out by mechanical attachment to a desired width during enhancing. However, the tension that this causes on the yarns inhibits blooming of the yarns during enhancing. Fabrics treated in this way fail to achieve optimum enhancement. Another disadvantage is that in order to hold the fabric out to width during enhancing, a complicated system of conveyor clips or pins for the moving web is required.

Accordingly, it is a principal object of the invention to provide an improved method of enabling full enhancement of hydroenhanced fabric to be achieved without loss of width.

A further object of the invention is to provide a method for eliminating shrinkage in hydroenhanced fabric that is less complex and improved over the prior art.

SUMMARY OF THE INVENTION

In accordance with the present invention, woven or knit fabric is pre-tentered (stretched) in a pre-tenter stage to a predetermined width in excess of a desired finished width of the fabric. The pre-tentering width is selected so that the expected shrinkage caused by the hydroenhancing process reduces the width of the enhanced fabric to slightly less than the desired finished width. A post-tenter stage is then used to post-tenter the fabric after enhancing only by a slight amount to the exact desired finished width. Since only a slight increase in width is required, there is little loss in the enhanced cover due to stretching the fabric after enhancing. Post-tentering a slight increase in width will also provide a slight tension for holding the fabric in the tenter clips and prevent the fabric from dragging in the tenter.

Other objects, features and advantages of the present invention will be apparent from the detailed description below considered in conjunction with the drawings, as follows:

BRIEF DESCRIPTION OF THE DRAWINGS

FIGS. 2A and 2B are photographs at 10× magnification of 36×29 90° and 40×40 45° mesh plain weave support members, respectively, employed in the flat and drum enhancing modules of FIG. 1.

DETAILED DESCRIPTION OF THE INVENTION

Figure 1:
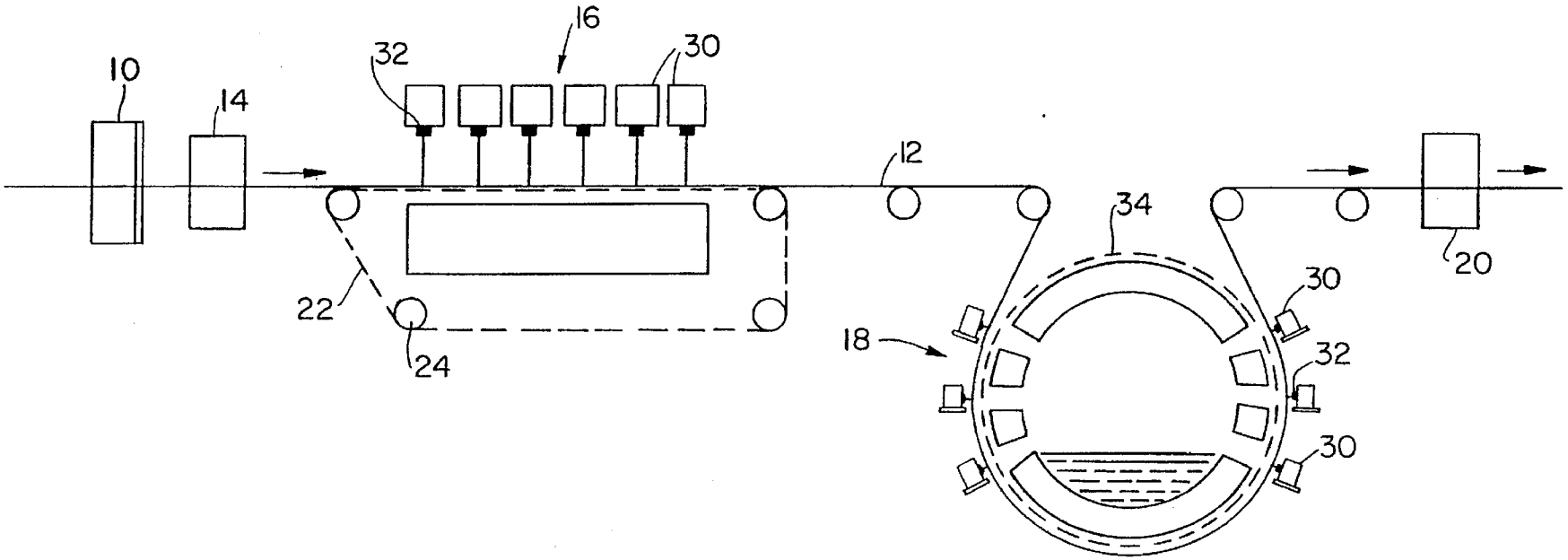
FIG. 1 is a schematic view of a hydroenhancement line including a weft straightener, flat and drum hydroenhancing modules, and tenter frame, for the hydroenhancement of woven and knit fabrics in accordance with the invention.

With further reference to the drawings, FIG. 1 illustrates a preferred embodiment of a hydroenhancement line for practicing the present invention. A web of fabric 12 including spun and/or spun/filament yarns is conveyed on the line through a pre-tenter frame 10, a weft straightener 14, a flat bed hydroenhancing module 16 and/or a drum hydroenhancing module 18, and a post-tenter frame 20.

The pre-tenter frame 10 is used to stretch the incoming fabric to a predetermined width in excess of the desired finished width of the fabric. The pre-tentering width is selected so that the expected shrinkage caused by the hydroenhancing process will reduce the width of the enhanced fabric to about equal to or slightly less than the desired finished width. The fabric is advanced through the weft straightener 14 which aligns the fabric weft prior to processing in enhancement modules 16, 18. The two modules 16, 18 are used to effect two-sided hydroenhancement of the fabric. Enhancement of the fabric is effected by entanglement and interwining of yarn fibers at cross-over points in the fabric. The enhancing process parameters are controlled in a known manner to obtain a desired uniform finish and improved characteristics, such as, cover, abrasion resistance, drape, stability, reduced air permeability, wrinkle recovery, absorption, adsorption, shrink resistance, seam slippage, edge fray, fabric weight and thickness. Following hydroenhancement, the fabric is advanced to the post-tenter frame 20, which is of conventional design, where it is dried under tension to produce a uniform fabric of the desired width.

The flat enhancement module 16 includes a first support member 22 which is supported on an endless conveyor driven on rollers 24. Preferred line speeds for the conveyor may be selected anywhere in the range of 10 to 500 ft/min. Line speeds are adjusted in accordance with process energy requirements which vary as a function of fabric type and weight. The support member 22 is generally a woven or perforated screen with closely spaced fluid pervious open areas 26, as illustrated in FIG. 2A. The support member shown is a 36×29 90° mesh plain weave having a 23.7% open area, which is fabricated of polyester warp and shute round wire.

Module 16 also includes an arrangement of parallel and spaced hydrojet manifolds 30 oriented in a cross-direction ("CD") relative to movement of the fabric 12. The manifolds are preferably spaced about 8 inches apart, and each is formed with a plurality of closely aligned and spaced columnar jet orifices 32 spaced vertically about 0.5 inches above the support member 22.

The jet orifices can have diameters and center-to-center spacings in the range of 0.005 to 0.010 inches and 0.017 to 0.034 inches, respectively, and are designed to impact the fabric with fluid pressures in the range of 200 to 3000 psi. Preferred orifices have diameters of approximately 0.005 inches with center-to-center spacings of approximately 0.017 inches.

This arrangement of fluid jets uniformly and continuously impacts the fabric with a continuous curtain of fluid entangling streams which yield optimum enhancement in the fabric. Energy input to the fabric is cumulative along the line and preferably set at approximately the same level in modules 16, 18 (two stage system) to impart uniform enhancement to top and bottom surfaces of the fabric. Effective first stage enhancement of fabric yarn is achieved at an energy output of at least 0.05 hp-hr/lb and preferably in the range of 0.1 to 2.0 hp-hr/lb.

Following the first stage enhancement, the fabric is advanced to module 18 which enhances the other side of the fabric. The drum hydroenhancement module 18 has a second support member 34 of cylindrical configuration which is supported on a drum. The member 34 includes closely spaced fluid pervious open areas 36 which can comprise, for example, about 36% of the screen area. As illustrated in FIG. 2B, the drum support member 34 can be formed with a 40×40 45° mesh stainless steel screen. Drum module 18 performs enhancing functions in the same manner as the flat module 16. Manifolds 30 and jet orifices 32 are provided as in the flat enhancement module. Fluid energy to the fabric of at least 0.05 hp-hr/lb and preferably in the range of 0.1 to 2.0 hp-hr/lb effects enhancement on the opposite side of the fabric. In one preferred embodiment the pressure is approximately 1500 psi, the jet orifice diameter is approximately 0.005 inches, the center-to-center spacing of the jet orifices is approximately 0.017 inches (60 jets per inch), and the fabric is impacted with a cumulative energy of approximately 0.46 hp-hr/lb.

Figure 3:
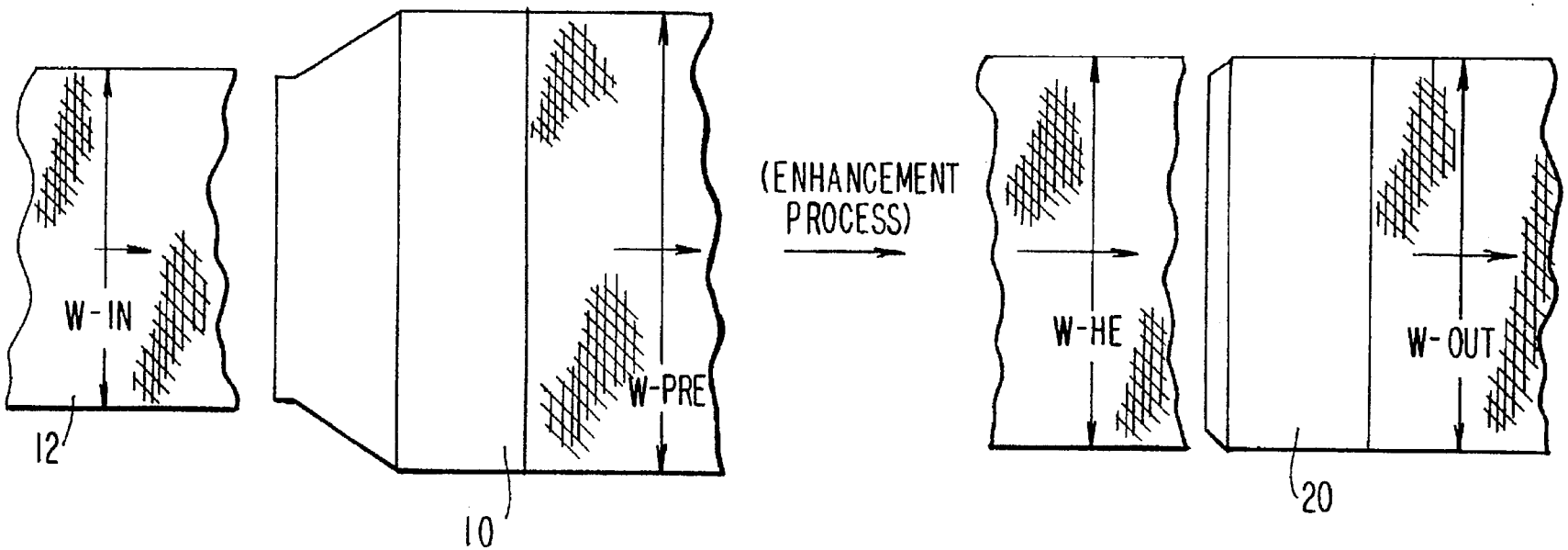
FIG. 3 is a schematic diagram illustrating the pre-tentering and post-tentering of fabric before and after hydroenhancement in accordance with the invention.

Referring to FIG. 3, the improvement of the present invention is now explained in further detail. The fabric 12 is pre-tentered (stretched) in the pre-tenter frame 10 prior to hydroenhancement treatment from an original width W-IN to a width W-PRE in excess of the desired finished width W-OUT of the fabric. The pre-tentered width W-PRE is selected so that the expected shrinkage W-HE caused by the hydroenhancing process reduces the width of the enhanced fabric to about equal to or slightly less than the desired finished width. The post-tenter frame 20 is used to stretch the fabric after enhancing by only a slight amount to the desired finished width W-OUT. Since only a slight increase in width is required, there is little loss in cover of the fabric after enhancing. Post-tentering a slight amount also provides a slight tension for holding the fabric in the tenter clips and preventing it from dragging in the tenter.

Enhanced fabrics of the invention are preferably fabricated of yarns including fibers having deniers and lengths, respectively, in the ranges of 0.3 to 10.0 and 0.5 to 6.0 inches, and yarn counts of 0.5 s to 80 s. Optimum enhancement is obtained in fabrics having fiber deniers in the range of 0.5 to 6, staple fibers of 0.5 to 6.0 inches, and yarn counts in the range of 0.5 s to 50 s. Preferred yarn spinning systems employed in the invention fabrics include open end cotton spun, wrap spun and open end wool spun. Experimentation indicates that preferred enhancement results are obtained in fabrics including low denier, short lengths fibers, and loosely twisted yarns.

An example comparing the results of subjecting fabric to hydroenhancement with conventional post-tentering and to hydroenhancement with pre- and post-tentering in accordance with the invention is provided below. In this example, a PFP fabric consisting of 100% polyester spun yarns was hydroenhanced at 0.5 hp-hr/lb.

| | ENHANCED W/CONV. PRE-TENTERING | ENHANCED W/ PRE- & POST-TENTERING |
|---|---|---|
| Before Enhancing | | |
| WIDTH (inches) | 54.5 | 61.5–62 |
| AIR PERM (cfm/sqft) | 289 | 379 |
| After Enhancing | | |
| WIDTH (inches) | 52 | 56.5–57 |
| AIR PERM (cfm/sqft) | 76 | 93 |
| After Post-Tentering | | |
| WIDTH (inches) | 57 | 57.5 |
| AIR PERM (cfm/sqft) | 160 | 113 |

In the example, the fabric before enhancing had an original width of 54 inches (W-IN) and was pre-tentered to about 62 inches (W-PRE) in the improved method of the invention. After enhancing, the control fabric had shrinkage to about 52 inches, while the fabric in the improved process shrank to about 56.6–57 inches (W-HE) which was slightly below the target width of 57 or 57.5 inches (W-OUT). After enhancement, the control fabric was post-tentered conventionally to 57 inches, while the fabric in the improved process was post-tentered only slightly to 57.5 inches. The fabric post-tentered in the conventional manner had an air permeability 160 cfm/sqft, whereas the fabric in the improved process had an air permeability of 113 cfm/sqft. This represented an improvement in the cover of the fabric after enhancing by about 33% for the same output width. The cost and complex equipment required for holding the fabric to a specified width through the flat conveyor and drum hydrojet stations during enhancing can also be avoided. The pre-tenter and post-tenter frames are located outside the enhancing zone and can be of conventional design.

It will be recognized that numerous modifications to implementation of the invention are possible in light of the above disclosure, and that the process of the invention has applicability for the enhancement of many different types of fabrics. The use of pre-tentering to an excess width, designed to offset the expected shrinkage of fabric passing through an enhancing treatment followed by only slight post-tentering to produce a stable fabric output, can also be used for other fabric enhancement processes besides hydroenhancement, for example, gas or other fluid treatments of fabric. It is intended that all such modifications and variations be included within the scope and spirit of the invention as defined in the claims appended hereto.

We claim:

1. An improved method for enhancing fabric of a given input width which is to be subjected to a fabric enhancement treatment for enhancing properties of the fabric, the fabric enhancement treatment including hydroenhancement of the fabric by impacting with jets of water, wherein shrinkage of the width of the fabric is expected to occur as a result of fabric enhancement treatment, comprising the step of:

pre-tentering the fabric to stretch it to a predetermined excess width before subjecting it to fabric enhancement treatment, wherein said predetermined excess width is selected so that the expected shrinkage of the width of the fabric as a result of the fabric enhancement treatment is to a width slightly less than a desired finished width for output enhanced fabric.

2. An improved method for enhancing fabric in accordance with claim 1, comprising the further step of:

post-tentering the fabric after the enhancement treatment to stretch it only by a slight amount sufficient to bring it to the desired finished width for the output enhanced fabric.

3. An improved method for enhancing fabric in accordance with claim 1, wherein the fabric enhancement treatment includes hydroenhancement of both sides of the fabric.

4. An improved method for enhancing fabric in accordance with claim 1, wherein the fabric comprises spun and/or spun filament yarns which intersect at cross-over points to define a fabric matrix and interstitial open areas.

5. An improved method for enhancing fabric in accordance with claim 1, wherein the jets of water impact the fabric with a fluid energy of 0.1 to 2.0 hp-hr/lb.

6. Improved apparatus for enhancing fabric of a given input width which is to be subjected to a fabric enhancement treatment in an enhancement zone for enhancing properties of the fabric, the enhancement zone including a module for hydroenhancement of the fabric by impacting with jets of water to improve the fabric properties, wherein shrinkage of the width of the fabric is expected to occur as a result of the fabric enhancement treatment, comprising:

a pre-tenter stage positioned before the enhancement zone for stretching the fabric to a predetermined excess width before subjecting it to fabric enhancement treatment, wherein said predetermined excess width is selected so that the expected shrinkage of the width of the fabric as a result of the fabric enhancement treatment in the enhancement zone is to a width slightly less than a desired finished width for output enhanced fabric.

7. Improved apparatus for enhancing fabric in accordance with claim 6, further comprising:

a post-tenter frame for stretching the fabric after the enhancement treatment only by a slight amount sufficient to bring it to the desired finished width for the output enhanced fabric.

8. Improved apparatus for enhancing fabric in accordance with claim 6, wherein the enhancement zone includes two enhancement modules positioned on opposite sides of the fabric for treating both sides of the fabric.

9. Improved apparatus for enhancing fabric in accordance with claim 6, wherein the fabric comprises spun and/or spun filament yarns which intersect at cross-over points to define a fabric matrix and interstitial open areas.

10. Improved apparatus for enhancing fabric in accordance with claim 6, wherein the jets of water impact the fabric with a fluid energy of 0.1 to 2.0 hp-hr/lb.

* * * * *